United States Patent [19]

Schmitt et al.

[11] Patent Number: 4,664,770

[45] Date of Patent: May 12, 1987

[54] ELECTROLYZER

[75] Inventors: Helmut Schmitt, Dortmund; Helmuth Schurig, Holzwickede; Dieter Bergner; Kurt Hannesen, both of Kelkheim, all of Fed. Rep. of Germany

[73] Assignee: Uhde GmbH, Dortmund, Fed. Rep. of Germany

[21] Appl. No.: 818,790

[22] Filed: Jan. 14, 1986

[30] Foreign Application Priority Data

Jan. 16, 1985 [DE] Fed. Rep. of Germany ..... 3501261

[51] Int. Cl.[4] ..... C25B 9/00; C25B 9/04; C25B 11/03

[52] U.S. Cl. ..... 204/252; 204/253; 204/282; 204/283; 204/284

[58] Field of Search ..... 204/253–258, 204/283, 284

[56] References Cited

U.S. PATENT DOCUMENTS 4,108,752 8/1978 Pohto et al. ..... 204/256
4,440,615 4/1984 Peré ..... 204/283 X
4,519,888 5/1985 Akazawa et al. ..... 204/252
4,584,080 4/1986 Staab et al. ..... 204/286 X

*Primary Examiner*—Donald R. Valentine
*Attorney, Agent, or Firm*—Marshall & Melhorn

[57] ABSTRACT

An electrolyzer for the production of chlorine from an aqueous alkaline halide solution includes a plurality of electrolysis cells each having a housing of two half-shells. The bottom side of each of the half-shells is in a plane parallel to a plane of an adjacent anode or cathode, the space between the bottom side and the anode or the cathode being provided with framework-pattern metallic reinforcements. Each bottom side has one or more contact strips attached to its outer surface which are arranged in a congruent position to the contact strips on the bottom side of the adjacent electrolysis cell, and extend over the length or width of the cell. The contact strips are aligned with and connected by electrically conducting means to part of the framework-pattern reinforcements and the unperforated sections of the adjacent anode or cathode. The two half-shells and a membrane partition wall are assembled to form an electrolysis cell sealed by two gaskets.

13 Claims, 3 Drawing Figures

ELECTROLYZER

BACKGROUND OF THE INVENTION

The invention relates to an electrolyzer for the production of chlorine from an aqueous alkaline halide solution, the electrolyzer comprising a plurality of electrolysis cells with each cell consisting of a housing composed of two half-shells. The housing is provided with facilities for admitting the electrolysis current and the electrolysis feedstock as well as facilities for discharging the electrolysis current and the electrolysis products. The anode and the cathode comprise a plurality of perforated and unperforated sections arranged in parallel, the anode being separated from the cathode by a partition wall. The half-shells of the housing are of square-shaped configuration and formed of electrically conducting material.

U.S. Pat. No. 4,029,565 describes an electrolyzer which consists of several electrolysis cells comprising a housing which is composed of two half-shells and is provided with the usual facilities for admitting and discharging the feedstock and effluent products, respectively, and for admitting and discharging the electrolysis current. The anode is separated from the cathode by a non-metal partition wall, called a membrane. The half-shells are formed of an electrically non-conducting material. Current is supplied in a spot-type flow from the cathode to the anode of the adjacent cell and the current is distributed in a star-shaped pattern across the anode and cathode. This method of current distribution is unfavorable with reference to the voltage drop across each electrolysis cell. In addition, high local current densities are generated at various points along the current path.

SUMMARY OF THE INVENTION

The object of the present invention is to provide an electrolyzer which prevents current concentration while providing a favorable current distribution in the electrolysis cell. The problem is solved according to the invention by an electrolysis cell design having a housing formed of two half-shells each having a bottom side extending in a plane parallel to planes including an anode and a cathode. The anode and the cathode are separated by a membrane and each of the anode and the cathode has a plurality of perforated and unperforated sections arranged in parallel. A metallic reinforcement is positioned between the anode and an adjacent inner surface of the bottom side of one half-shell, and between the cathode and an adjacent inner surface of the bottom side of the other half-shell. A contact strip is attached to an outer surface of each of the bottom sides, the contact strips of adjacent cells being electrically connected. Also provided are means for electrically connecting each of the contact strips to the metallic reinforcement and the unperforated sections in the attached half-shell. A partition membrane extends between the anode and the cathode in each of the cells and gasket means seal the half-shells to the membrane.

The cathodes can be formed of iron, cobalt, nickel or chromium or any of their alloys, while the anodes can be formed of titanium, niobium or tantalum or any alloy of these metals, or of a metal or of an oxide of ceramic character. In addition, the anodes are provided with an electrically conducting and catalytically active coating which contains metals of the compounds of the platinum metal group. The configuration of the electrodes is perforated material such as punched sheet metal, expanded metal, interlaced material or structures of thin metal sheets with louver-type openings and their arrangement in the electrolysis cell permits the gas liberated by the electrolysis process to penetrate readily into the space behind the electrodes. This discharge of gas from the electrode gap ensures a reduction of the gas pocket resistance between the electrodes and, consequently, a lowering of the cell voltage.

The housing half-shell may be formed of the cathode material or the anode material respectively. In any case, the half-shell of the anode end must be fabricated from a chlorine-resistant material.

The framework-pattern reinforcements between the half-shell and the electrode are preferably fabricated from the same material as the electrode concerned.

The partition membrane wall may be selected from the ion exchange membranes that are a standard item in alkaline chloride electrolysis plants. A co-polymer of tetrafluoroethylene and perfluorovinylether sulfonic acid, for example, is suitable for use as ion exchange material.

This ion exchange membrane prevents the mixing of hydrogen and chlorine but, because of its selective permeability, permits the passage of alkali metal ions into the cathode chamber. Thus, it prevents substantially the transfer of halide into the cathode chamber and the penetration of hydroxyl ions into the anode chamber. This process yields a virtually salt-free caustic solution.

The electrolyzer may consist of one electrolysis cell or of a plurality of series-connected cells, the electrical contact between adjacent cells being ensured by electrically conducting contact strips.

BRIEF DESCRIPTION OF THE DRAWINGS

The electrolyzer according to the invention may be described by way of example with reference to the drawings.

DETAILED DESCRIPTION OF THE PREFERRED EMBODIMENT

Figure 1:
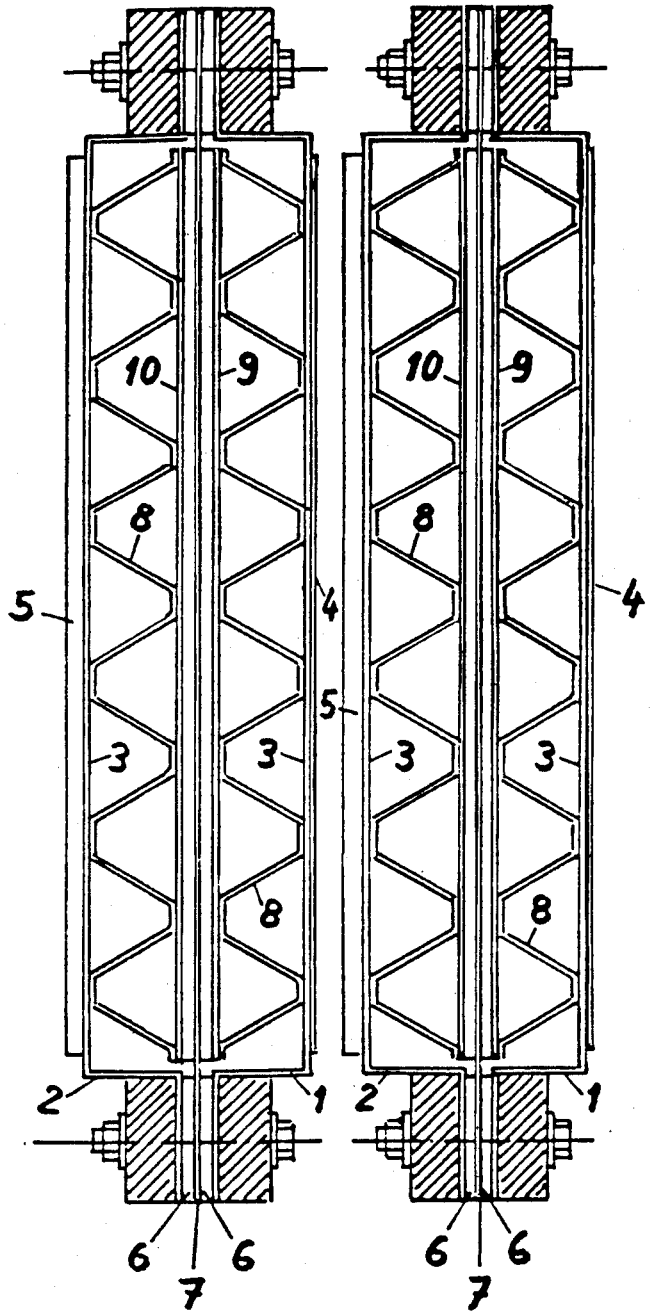
FIG. 1 is a cross sectional view of an electrolyzer having two electrolysis cells according to the present invention.

The housing of each of the electrolysis cells shown in FIG. 1 consists of the half-shells 1 and 2 with bottom 3 and contact strips 4 and 5 attached to an outer surface of the bottom sides 3. The half-shells are provided with flange-like edges for clamping a membrane 7 by means of gaskets 6. Other known means may also be used for clamping in place the membrane 7. Within the half-shells 1 and 2, framework-pattern metallic reinforcements 8 are fixed, generally welded, to an inner surface of the bottom of the half-shells 1 and 2 and serve for supporting an anode 9 and a cathode 10 on the opposite sides of the housing. The reinforcements 8 are each formed as a repeating series of four linear sections. Starting adjacent the bottom of one of the half-shells, a first shorter section extends parallel to the plane of the half-shell bottom and is connected to a first longer section which extends in a direction non+perpendicular to the plane of the half-shell bottom from the half-shell bottom to the associated anode or cathode. The first longer section is connected to a second shorter section which extends parallel to the plane of the anode or cathode. The second shorter section is connected to a second longer section which extends in a direction non-perpendicular to the plane of the half-shell bottom from the anode or cathode back to the half-shell bottom. The shorter sections provide a much larger current flow area than prior art round or square cross-section spacers as well as better current distribution. In addition, the reinforcement, the contact strip and the unperforated sections of the anodes and the cathodes are aligned to reduce the current flow path and associated voltage drop. The electrodes are designed to permit an unobstructed flow of both the electrolysis feedstock and effluent products. Each electrolyzer cell is equipped with the usual feedlines and discharge lines. These lines are not shown in the drawings to avoid confusion.

By lining up a number of electrolysis cells with the aid of known tensioning devices as is typical for filter press assemblies, adjacent contact strips 4 and 5 are forced together to ensure electrically conducting contact of adjacent cells. From a contact strip 4, the electric current passes through the half-shell bottom 3, across reinforcements 8 and into the anode 9. After penetration through membrane 7, the electric current enters the cathode 10 and passes through reinforcements 8 into the other half-shell bottom 3 and further into the contact strip 5 of the same cell. Current flow continues into a contact strip 4 of the next cell.

Figure 2:
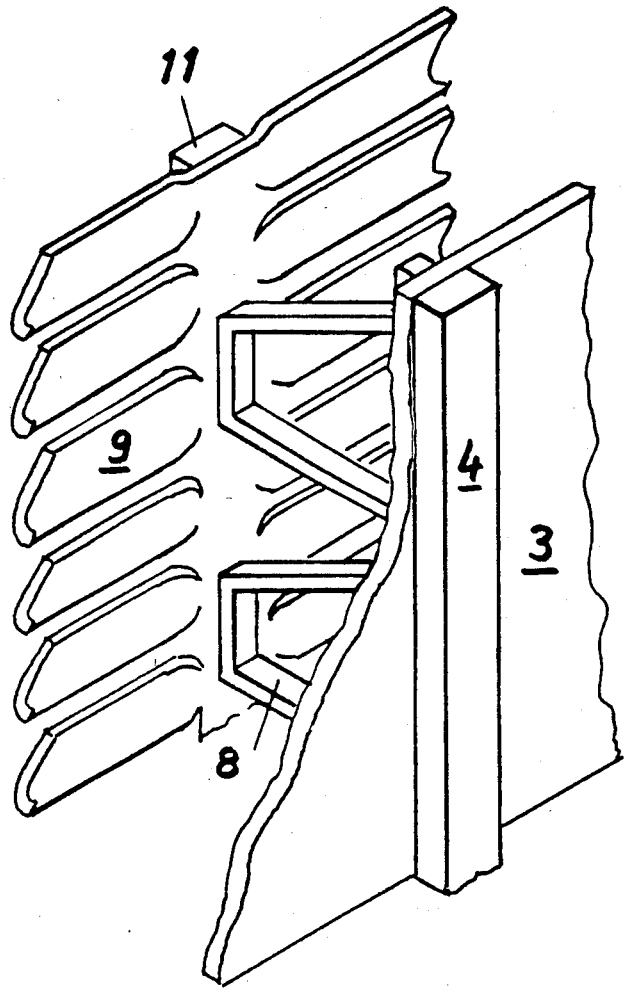
FIG. 2 is a perspective view of a portion of one of the cells of FIG. 1.

FIG. 2 is a perspective view of a portion of the contact strip 4, the reinforcements 8 and the louver-type configuration of electrode 9. This configuration permits the electrolysis fluids and products to pass into and exit from the electrolysis space between the electrodes without obstruction. Depending on specific requirements, one or more spacers 11 may be provided ahead of anode 9 or cathode 10. These spacers extend preferably in a vertical direction along part or the entire length of the electrode. The strip 5 and electrode 10 are of similar construction.

Figure 3:
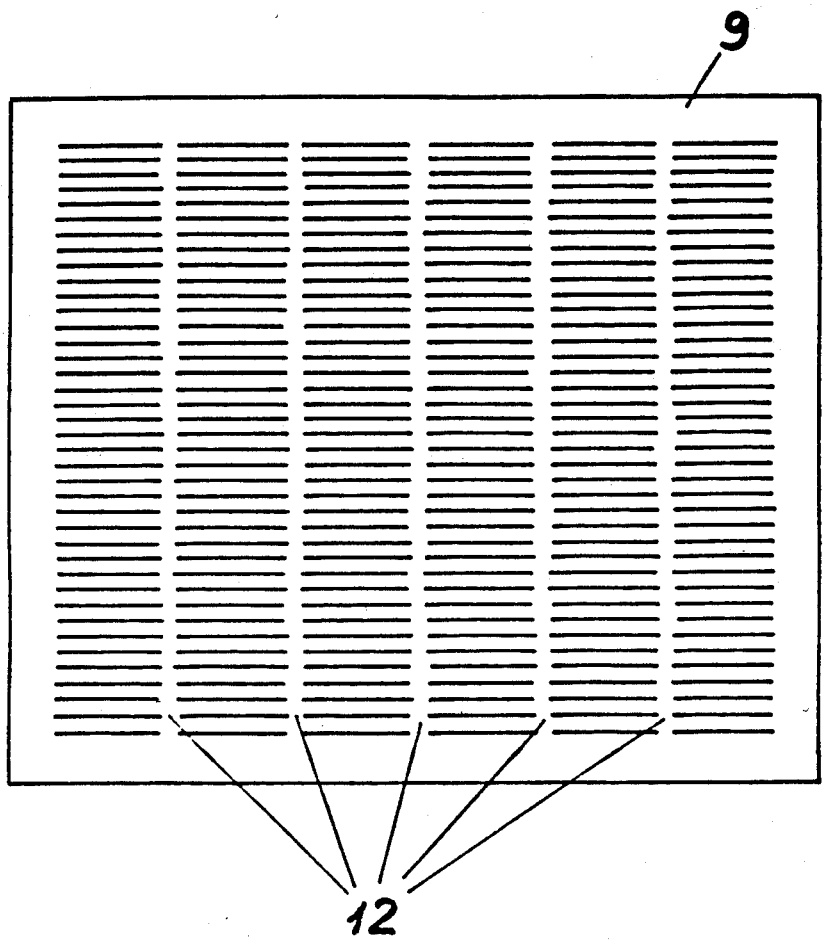
FIG. 3 is a plan view of an electrode of louver-type design with unperforated sections according to the present invention.

FIG. 3 depicts an electrode, this may be anode 9 as shown or cathode 10, which shows the unperforated section 12. The rear side of these unperforated sections is connected by electrically conducting means to reinforcements 8 as shown in FIG. 2. Contact strips 4 and 5 are arranged on half-shell bottoms 3 in alignment with the framework-pattern metallic reinforcements 8. This design ensures a short current path from the contact strips to the electrode, a low current density and an optimum current distribution across the electrode. The design as provided for by the invention maintains the voltage drop across a cell or a complete electrolyzer at a low level.

In accordance with the provisions of the patent statutes, the principle and mode of operation of the invention have been explained and illustrated in its preferred embodiment. However, it must be understood that the invention can be practiced otherwise than as specifically illustrated and described without departing from its spirit or scope.

What is claimed is:

1. An electrolyzer for the production of chlorine from an aqueous alkaline halide solution, including at least one electrolysis cell having a housing formed of two half-shells enclosing an anode and a cathode separated by a membrane, each of the anode and cathode having a plurality of perforated and unperforated sections arranged in parallel comprising:

each of the half-shells having a bottom side extending in a plane parallel to planes including the anode and the cathode;

a metallic reinforcement positioned between each of the anode and an adjacent inner surface of said bottom side of one of the half-shells, and between each of the cathode and an adjacent inner surface of said bottom side of the other one of the half-shells, each of said reinforcements formed as a repeating series of four linear sections, one of said sections extending generally parallel to and adjacent one of the half-shell bottom sides, a second one of said sections extending generally parallel to and adjacent an associated one of the anode and the cathode, a third one of said sections connected between ends of said first and second sections and extending in a direction non-perpendicular to the planes of said half-shell bottom sides, and a fourth one of said sections connected to an opposite end of said second section and extending in a direction non-perpendicular to the planes of said half-shell bottom sides between said one half-shell bottom side and said associated on of the anode and the cathode;

a contact strip attached to an outer surface of each of said bottom sides;

means for electrically connecting each of said contact strips to said corresponding metallic reinforcement and said unperforated sections of the corresponding one of the anode and cathode in the attached half-shell; and a partition membrane extending between said anode and said cathode and gasket means sealing the half-shells to said membrane.

2. The electrolyzer according to claim 1 wherein said half-shell containing an anode is formed of a chlorine-resistant electrically conducting material.

3. The electrolyzer according to claim 1 wherein said half-shell containing a cathode is formed of an electrically conducting material that is resistant to alkaline solution.

4. The electrolyzer according to claim 1 wherein said reinforcements are formed in a single plane.

5. The electrolyzer according to claim 1 wherein said contact strips have a smooth outer surface.

6. The electrolyzer according to claim 1 wherein said reinforcements are connected to said bottom side inner surface opposite a connection of said contact strip to said bottom side outer surface.

7. The electrolyzer according to claim 1 wherein said first and second sections are shorter than said third and fourth sections.

8. An electrolyzer for the production of chlorine from an aqueous akaline halide solution, the electrolyzer having a plurality of self-contained electrolysis cells, each cell having two half-shells enclosing a partition membrane and sealed with gaskets, an anode and a cathode generally planar and positioned on opposite sides of the membrane and each having perforated and unperforated sections arranged in parallel, the half-shells formed of electrically conducting material each with a bottom side extending in a plane generally parallel to the planes of the anode and the cathode, comprising:

a framework-pattern metallic reinforcement extending between each of the half-shell bottom sides and an associated one of the anode and the cathode;

a plurality of contact strips attached to outer surfaces of the half-shell bottom sides, each of said contact strips longitudinally aligned and in electrical contact with an associated one of said contact strips attached to an adjacent electrolysis cell; and means for electrically connecting each of said reinforcements between an associated one of said contact strips and an associated unperforated section of one of the anode and the cathode.

9. The electrolyzer according to claim 8 wherein the half-shells associated with the anodes are formed of a chlorine-resistant electrically conducting material.

10. The electrolyzer according to claim 8 wherein the half-shells associated with the cathodes are formed of an electrically conducting material that is resistant to alkaline solutions.

11. The electrolyzer according to claim 8 wherein said framework-pattern reinforcements extend longitudinally in a plane.

12. The electrolyzer according to claim 8 wherein said contact strips have a smooth outer surface for abutting one another.

13. The electrolyzer according to claim 8 wherein said reinforcement, said contact strips and said unperforated sections are longitudinally aligned with one another to form current flow paths through the cells.

* * * * *